US006832586B2

(12) United States Patent
Williams

(10) Patent No.: US 6,832,586 B2
(45) Date of Patent: Dec. 21, 2004

(54) VARIABLE DURATION CAMSHAFT

(75) Inventor: Danny Russell Williams, Highfields (AU)

(73) Assignee: Transtar Pacific Limited, Wanchai (HK)

( * ) Notice: Subject to any disclaimer, the term of this patent is extended or adjusted under 35 U.S.C. 154(b) by 0 days.

(21) Appl. No.: 10/399,794

(22) PCT Filed: Oct. 23, 2001

(86) PCT No.: PCT/AU01/01360

§ 371 (c)(1),
(2), (4) Date: Oct. 9, 2003

(87) PCT Pub. No.: WO02/35065

PCT Pub. Date: May 2, 2002

(65) Prior Publication Data

US 2004/0050353 A1 Mar. 18, 2004

(30) Foreign Application Priority Data

Oct. 23, 2000 (AU) ..... PR0930

(51) Int. Cl.[7] ..... F01L 1/34

(52) U.S. Cl. ..... 123/90.17; 123/90.16; 123/90.18; 123/90.6

(58) Field of Search ..... 123/90.2, 90.26, 123/90.27, 90.31, 90.34, 90.6, 90.61, 90.15, 90.16, 90.17, 90.18; 29/888.1

(56) References Cited

U.S. PATENT DOCUMENTS

| | | | | | |
|---|---|---|---|---|---|
| 3,523,465 | A | * | 8/1970 | Harrell | 74/568 R |
| 3,824,963 | A | * | 7/1974 | Eda | 418/38 |
| 4,388,897 | A | | 6/1983 | Rosa | |
| 4,505,235 | A | * | 3/1985 | Mitchell | 123/90.17 |
| 5,129,407 | A | * | 7/1992 | Phillips | 123/90.18 |
| 5,235,939 | A | * | 8/1993 | Levin et al. | 123/90.15 |
| 5,441,021 | A | | 8/1995 | Moore, II | |
| 5,862,783 | A | | 1/1999 | Lewis | |
| 6,427,653 | B1 | * | 8/2002 | Hara et al. | 123/90.17 |

* cited by examiner

*Primary Examiner*—Thomas Denion
*Assistant Examiner*—Jaime Corrigan
(74) *Attorney, Agent, or Firm*—Woodcock Washburn LLP

(57) ABSTRACT

A variable timing duration camshaft has an outer shaft (1) and coaxial inner shaft (2) adapted so that the shafts (1, 2) are relatively slidable but not rotatable about each other. The outer shaft (1) has valve control lobes located on its outer surface and a valve control lobe modifying segments (4) is located on the inner shaft (2) and is slidingly fitted into a mating slot (5) in the outer shaft and in the valve control lobe whereby longitudinal axial movement of the inner shaft (2) relative to the outershaft by a control means (13, 14) causes the modifying segment (4) to move longitudinally and circumferentially relative to the valve control lobes thereby varying the duration.

16 Claims, 3 Drawing Sheets

VARIABLE DURATION CAMSHAFT

FIELD OF THE INVENTION

This invention relates to camshafts for four stroke internal combustion engines. More particularly it relates to camshafts that cause engine speed variable timing duration of combustion chamber valves and allow throttle-free engine load control by adjusting the valve timing.

BACKGROUND OF THE INVENTION

Both petrol and diesel four stroke engines typically use a camshaft to control the opening and closing of the engine's intake and exhaust valves. Normally the open period of the valves, usually referred to as the "duration" or "dwell", is fixed by the valve lobe shape or profile ground onto the lobe of the camshaft when it is manufactured. Normally, this profile cannot be varied without the physical replacement of the camshaft by another with a different profile ground onto its lobes.

On some engines that are described as having variable camshaft timing, the opening and closing points of the valves can be varied but the actual duration or dwell of the valve opening remains fixed. A conventional camshaft that provides a fixed amount of valve opening allows an engine to achieve maximum volumetric efficiency, and hence torque, at only one point in the engine's revolution range. The torque falls off on either side of this point.

A camshaft arrangement which allows the valve opening duration to be varied so as to maximise the torque throughout the engine's revolution range would be very desirable. This fact has long been realised by engine designers and much effort has been expended in the search of a mechanical variable duration system of valve timing. No successful system has been achieved for a mechanical continuously variable system of valve timing duration. Systems which are not continuously variable but operate on a two-stage principle, such as Honda's VTEC system, have been adopted and are highly successful. Much effort is being spent on investigating hydraulic, pneumatic and solenoid systems of variable duration valve timing. Although the main advantage of a variable duration timing camshaft is to improve the torque spread of an engine it could be used to provide throttle-free control of the engine's induction to minimise intake pumping losses and/or to achieve low exhaust emissions.

It has been proposed to use a camshaft having two closely spaced cam lobes in combination with a wider than normal follower, or tappet, that rides on both lobes simultaneously. A mechanism is provided so that the lobes can be aligned to give minimum duration or misaligned to give an increase in duration. If the misalignment does not exceed the angular distance of constant radius of the cam lobe's nose, the follower "sees" the constant radius area as a continuous surface. The main deficiency of these devices is that the useable duration range is limited to twice, measured in degrees of rotation of the crankshaft, that of the angular span of the constant radius at the lobe's nose. Any attempt to increase the duration past this angular distance results in the follower falling into the gap between the two lobe noses causing unacceptable noise and wear. There have been solutions proposed to this problem, but none have been commercially successful. There is a wide range of possible variations in lobe profiles, style of construction, even using lobes on two separate shafts, and methods of control and actuation of the duration change. However, none of these have provided a successful product.

It would be desirable to increase the upper duration limit to a much greater extent. This would lead to throttle free control. This would minimise pumping losses and would improve the overall fuel efficiency of a petrol engine to a level similar to that of a diesel engine. To achieve throttle free control of an engine it would need a maximum duration on the intake valve of something like 360 crankshaft degrees. The base duration on the intake valve of a typical road going engine is about 250 degrees with the valve opening 20 degrees before the top dead centre (BTDC) and closing 50 degrees after bottom dead centre (ABDC). This is normally expressed in conventional notation as 20-50/50-20 assuming the exhaust valve timing is also 250 degrees. Delaying the closing of the intake valve would cause some of the drawn in air and fuel mixture to be pushed back out of the cylinder before the intake valve closes thus resulting in a lesser amount of mixture to be combusted. By appropriately varying the amount of late closing of the valve, throttle free control of engine load could be achieved. For the minimum amount of power required that is, at idle, it would be expected that a closing point of about 160 degrees ABDC would be needed. As the intake valve opens at 20 degrees BTDC this would result in a total maximum duration of around 360 degrees being necessary, a range of 110 degrees. In conventional notation the valve timing at idle power would be written as 20-160/50-20. This is well beyond the capability of the earlier type of variable duration mechanism which has a typical range of 30 to 40 degrees.

SUMMARY OF THE INVENTION

This invention provides in one form a variable timing duration camshaft comprising an outer shaft and coaxial inner shaft wherein the shafts are adapted for relative slidable but not relative rotational engagement, and wherein the outer shaft has located in its outer surface valve control lobes, and wherein a valve control lobe modifying segment is located on the inner shaft and is slidingly fitted into a mating slot in the outer shaft and optionally in the valve control lobe whereby longitudinal axial movement of the inner shaft relative to the outershaft by a control means causes the modifying segment to move longitudinally and circumferentially relative to the valve control lobes thereby varying the duration.

In an alternative form the invention provides internal combustion engines having a variable timing duration camshaft as described above.

BRIEF DESCRIPTION OF THE DRAWINGS

FIG. 1(*b*) is a sectional end view of FIG. 1(*a*).

FIG. 1(*c*) is a sectional front view of the camshaft FIG. 1(*a*) showing increased duration.

FIG. 1(*d*) is a sectional end view of FIG. 1(*c*).

FIG. 3(*b*) is a sectional end view of FIG. 3(*a*).

DETAILED DESCRIPTION OF THE INVENTION

Figure 1B:
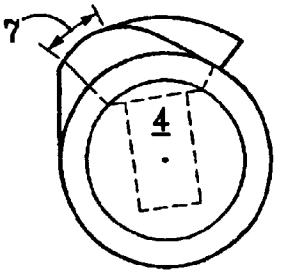
FIG. 1(*a*) is a sectional front view of a variable timing camshaft in a first position.
Figure 1D:
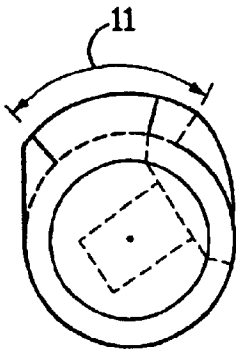
Figure 1A:
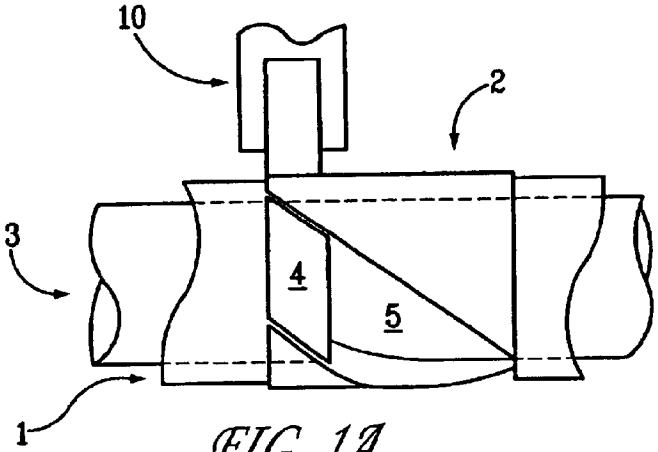
Figure 1C:
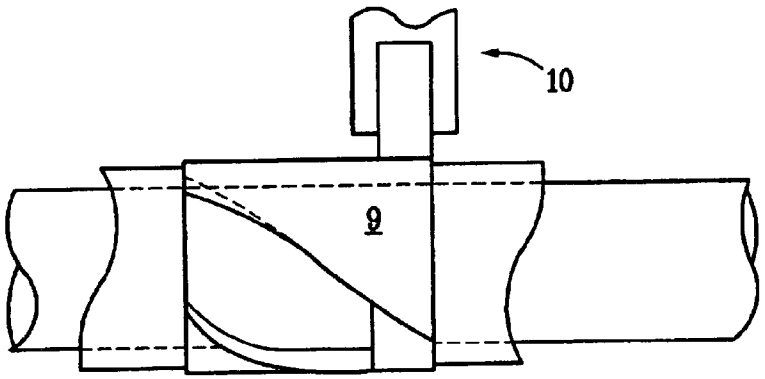

The general layout is shown in FIG. 1(*a*). The main body of the lobe assembly is part of the outer shaft. The lobe is typically elongated along the longitudinal axis of the shaft. If a maximum duration of 360 degrees is desired then typically the lobe would be about 40 mm long. To describe the shape of the lobe it is useful to explain how the prototype lobe was made The main lobe blank was initially ground with a 360 degree duration profile. This profile has a 250 degree profile modified to have a 20 (camshaft) degree constant radius region at its point of maximum lift. To this basic profile 55 (camshaft) degrees are added to the constant radius area, making it 75 degrees in total, giving an overall duration of 360 degrees. A slot is cut into this lobe from the beginning of the constant radius area to the beginning of the base circle, (the base circle of the 250 degree profile.) The slot runs diagonally across the 75 degree constant radius area typically at about a 45 degree helix angle as shown in FIG. 1. The removal of the slot material leaves a small triangular shaped remnant of the original 360 degree profile which must be ground away to the level of the base circle. In this slot is the helically shaped lobe segment blank attached to an inner shaft.

Typically the segment would be about 10 mm wide with its leading and trailing edges inclined at the same angle as the helical slot in the main body of the lobe. The lobe segment would be sized so as to be a neat sliding fit in the slot. The main body and lobe segment blank are then reground to the original 360 degree profile with the lobe segment locked in position at the extremity of the main body of the lobe which has the maximum amount of constant radius area. This has the effect of giving a duration of 360 degrees at one end of the lobe while giving a duration of 250 degrees when the lobe segment is positioned at the other end of the lobe. Intermediate positions of the lobe segment between the two extremes give an infinite range of duration values between 250 and 360 degrees. This is because as the lobe segment moves relative to the main body of the lobe the lobe segment follows the helical path of the slot and progressively more or less, depending on the direction of movement, constant radius area is added or subtracted to the composite profile as seen by the cam follower.

In practice, there would seem to be little possible use in an engine for a duration greater than about 360 to 380 degrees. However, there may be some possible industrial uses. There may also be practical limits, due to lack of space, for excessively long cam lobes. The longer the maximum possible duration the longer the lobe would need to be. If it was desired to have only a moderate duration range, for example, 30 to 40 degrees, then less extreme lobe sizes would be adequate.

In contrast to an alternative mechanism where the duration basically expanded symmetrically about the lobe centre line, that is, advanced and retarded by equal amounts, to achieve throttle free control the duration would expand only in the retarding sense. If it was desired to have duration control to maximise the torque output over a wide rpm range, as well as throttle free control then the two styles of duration variation would have to be combined. Separately the mechanisms necessary to control each type of duration change function is fairly straightforward.

It is envisaged that with this mechanism of this invention a simple mechanical connection to the accelerator pedal would suffice to give throttle free control of the engine.

Combined control could be by two separate hydraulic actuators each with separate controlling systems. One actuator would control the main phasing of the camshaft overall, that is, the rotational position of the outer shaft relative to the crankshaft. The second actuator would be mounted on and spin with the outer shaft and control the degree of retardation of the inner shaft to allow throttle free control. Both actuators could be of conventional design as used in current variable cam timing systems. Duration control with the slot type camshaft is slightly more complex as it involves both rotational and axial movement of at least one of the shafts. If the new type of cam is to be used only to maximise torque throughout the rpm range, then a modified centrifugal mechanism which allowed some axial movement would be suitable. Throttle free control would be achieved by axial movement of one of the shafts. However, in practice it would be most likely that as throttle free control needs such a large range of duration change, far more than for maximising torque only, that the opportunity to combine both functions would be important.

The system is also slightly complicated by the fact that generally it would be more convenient for the lobe segment and inner shaft to remain aligned with the follower and valve stem. This would mean that the outer shaft and attached fixed lobes would need to move axially. It would be much simpler mechanically to move the inner shaft only but this would complicate the follower situation. The system would employ a follower of about normal width. This would mean that if a roller follower was used it could be of standard dimensions and weight.

With the slot, preferably helical, arrangement there is no gap at all for the follower to traverse only the diagonal joint between the main body of the lobe and the lobe segment. A diagonal joint of a rail on which a steel wheel runs is the preferred traditional engineering method of achieving a smooth transition from one rail to the next. Whether the mechanism is in the minimum or maximum duration position, or anywhere in between, the follower sees the crossing from lobe to lobe segment in exactly the same way. This gapless transition is the basic reason why the helical slot type camshaft appears to be a different class of mechanism.

The helical type would need a twin cam engine to take advantage of its full capabilities and probably could not be easily fitted to any existing unmodified engine.

Referring to FIGS. 1(*a*)-1(*d*) of the helical type camshaft consists basically of an outer hollow shaft (1) on which is mounted the main part of the cam lobe (2). Inside the outer hollow shaft (1) and coaxial with it is the inner shaft (3) on which the lobe modifying segments are attached as shown in the end view (4). The lobe modifying segment (4) protrude through helical shaped slots (5) in the outer shaft (1) and cam lobe (2). The lobe modifying segments (4) are helical in shape along their sides and have an inner shaft and are a sliding fit in the helical slots. The inner shaft (3) is free to rotate but is prevented from moving in either direction along its longitudinal axis. The outer shaft (1) can be slid longitudinally over the outside of the inner shaft (3) but is restrained from rotational movement relative to the camshaft belt pulley or chain sprocket. By moving the outer shaft longitudinally (9) relative to the inner shaft (3) the inner shaft (3) is forced to rotate and move the lobe modifying segments (4) and thereby varying the duration. The cam follower or tappet (10) remains fixed laterally, in line with the lobe segment. The duration can also be varied by changing the rotational position of the inner and outer shafts with respect to each other. In this case the relative rotational movement causes the outer shaft to move longitudinally, the movement being accommodated by suitable means such as by splines.

The helix angle is set by a diagonal line drawn across the 20 degrees of constant radius area (7) when the lobe insert is in the minimum duration position. This diagonal marks one edge of the helical slot. The other edge of the slot begins at the point where the lobe flank rejoins the base circle (base circle of a 250 degree profile) and runs parallel to the other edge. When the lobe segment is in the minimum duration position the overall combined profile is identical to the original modified Charade profile. As the typical width of a cam lobe is about the same as the linear distance of the constant radius area, the helix angle tends to be around 45 degrees but depending on the application could be anywhere in the range from about 30 to 60 degrees. Fins diagonal is continued across the main body of the lobe extending the constant radius area by about 55 degrees making it about 75 degrees (11) in total. The extension of the constant radius area can be varied to suit the particular applications of the camshaft. In the example of FIG. 1 the camshaft would be suitable for throttle free control and is about 360 degrees in duration.

Figure 2:
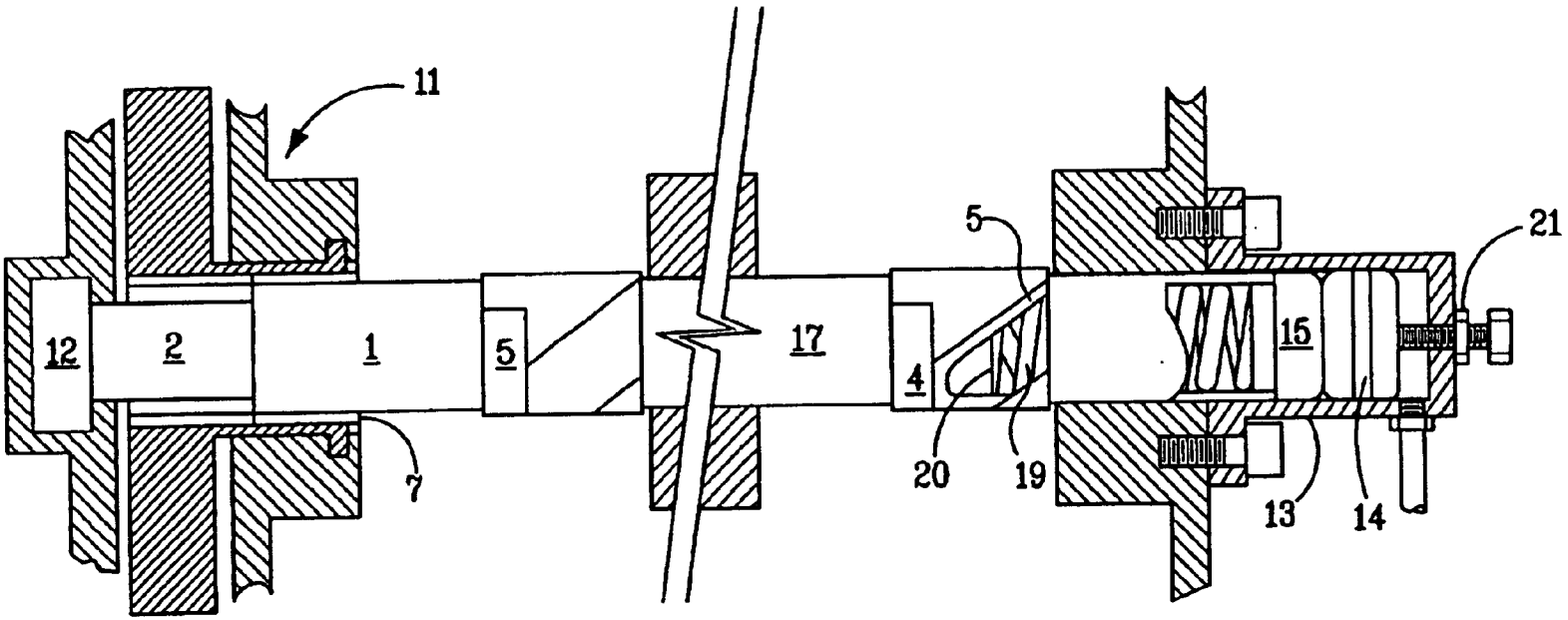
FIG. 2 is a part sectional view of the improved camshaft.

Referring to FIG. 2, the following description applies to the intake valve lobes only, the exhaust valve lobes remaining fixed as with a conventional camshaft. Although it would be theoretically possible to have helical type variable intake valve lobes and fixed exhaust valve lobes on the same camshaft, for practical reasons such as space, it is more likely that the principle be applied to twin cam engines. The outer shaft (1) slides forward over the inner shaft (2). To allow this movement the outer shaft has splines (7) which engage spline grooves (9), (dashed line) in the camshaft drive belt pulley, or chain sprocket, which is combined with the front camshaft bearing. The pulley/camshaft bearing is located by a flange (10) in the cylinder head casting (11). The inner shaft (2) is prevented from moving longitudinally in either direction by a thrust bearing (12) in the head casting. At the rear end of the camshaft hydraulic pressure (16) acting in a cylinder (13) causes a piston (14) and thrust bearing (15) to move the outer shaft (1) forward over the inner shaft (2). The surface of the outer shaft (1) in areas such as (17) is machined as a bearing surface so that as the outer shaft (1) moves through the camshaft bearing block (18) it remains supported.

The outer shaft (1) is restrained from any rotation relative to the camshaft drive pulley by the spline system in the pulley. The forward movement of the outer shaft (1) causes the lobe insert (4) to move relative to the helical slot (5). Even though the lobe insert (4) moves relative to the slot and rotates, it remains stationary axially and in alignment with the fixed cam follower (5) causing the cam follower to see varying amounts of duration depending on the position of the outer shaft (1) relative to the inner shaft (2). When pressure on the accelerator is released, thus also releasing hydraulic pressure, a return spring (19) acting on the end of the inner shaft (20) returns the outer shaft to its original position of maximum duration, that is, maximum late closing of the intake valve, or minimum power which is the position of the camshaft shown in the FIG. 2. An adjustable screw (21) prevents the hydraulic piston returning fully and thus gives a means of adjusting the idle speed.

It is clear that many variations of the overall layout described above are possible. For instance, the hydraulic assembly, return spring, etc could be at the front, or drive end, of the camshaft. It would also be possible to use a totally mechanical, rather than hydraulic, connection to the accelerator pedal, or electrical/electronic, or vacuum assisted actuation. The helix angle could be in the opposite sense, or the whole system could be arranged so that the inner shaft was the primary driven shaft and not the outer shaft. The cam follower could be made moveable to follow the lobe insert which would simplify the camshaft overall but complicate the follower arrangement.

Figure 3B:
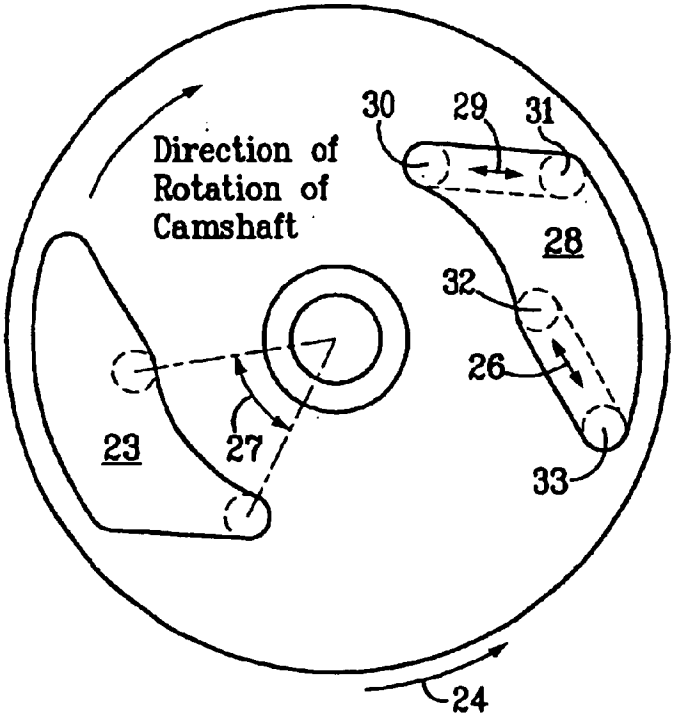
FIG. 3(*a*) is an enlarged sectional front view of a camshaft.
Figure 3A:
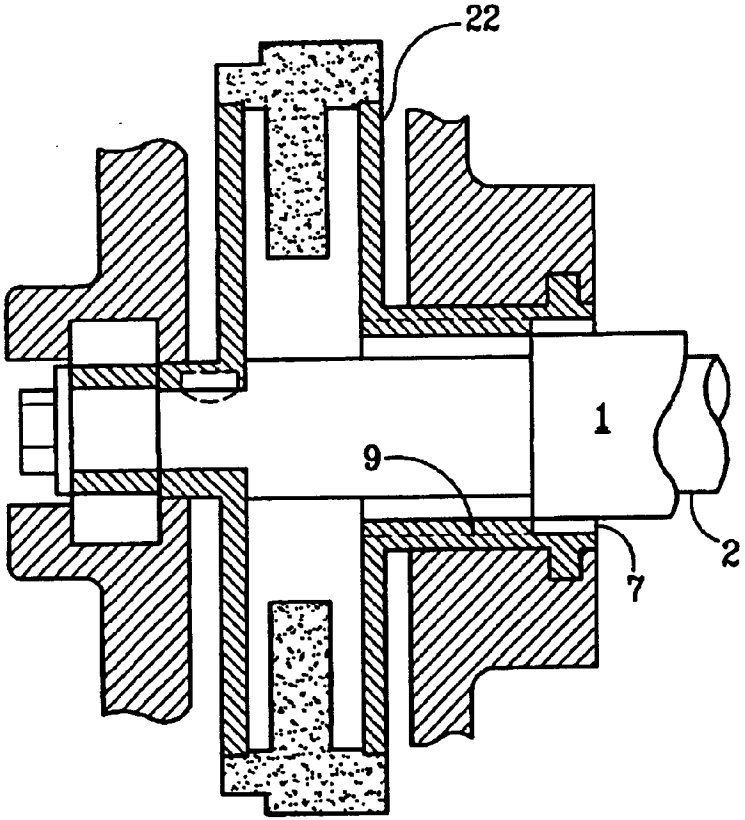

Referring to FIGS. 3(*a*) and 3(*b*), this figure shows the helical type camshaft when used to provide the combined functions of duration change with rpm to maximise torque over a wide range of rmp with variable late closing of the intake valve to give throttle free engine load control. In FIGS. 3(*a*) and 3(*b*), only the intake valve lobe mechanism is described. The exhaust valve duration would have to vary with rpm also to maximise torque but this is not shown here. It is most likely that engines with the combined functions would need to be twin cam. Basically, the camshaft layout remains identical to that shown in FIG. 2 with the addition of a centrifugal mechanism incorporated into the drive pulley or sprocket.

The scheme illustrated in FIG. 3 takes advantage of the fact that rotating the inner and outer shafts relative to each other, which gives some incidental movement of the outer shaft, or moving the outer shaft forward over the inner shaft. In FIG. 3 the centrifugal mechanism adjusts the rotational position of the inner and outer shafts depending on the rpm while the throttle free function is superimposed on the top of this function by moving the outer shaft relative to the inner shaft in a lengthways sense.

The rear drive flange (22) is incorporated into the front bearing in a similar manner to that shown in FIG. 2. As well as being employed as the mounting point for the thrust bearing (12) used to restrain the axial movement of the inner shaft the drive slots are totally different in shape. The drive slots, as used in the centrifugal mechanism are split along their long axis and opened up circumferentially by 55 degrees (27) or whatever amount is needed for a particular application to become large irregularly shaped apertures (28) in the drive flange. When the engine is at full load the outer shaft is fully forward and the drive pins would be at one extremity of the aperture along the line (29). They are held in this position by the load on the accelerator pedal by the driver's foot, when the system is only mechanical. If full throttle was held between about 2500 rpm and maximum rpm, the drive pin would travel progressively from point (30) to point (31), the incidental movement of the outer shaft would cause the accelerator pedal to actually rise very slightly under the driver's foot. If the rpm were to rise from 2500 rpm to maximum rpm with the accelerator not depressed at all, that is at minimum engine load, the drive pin would follow a path (26) from (32) to (33).

The drive is positioned along line 25 depending on rpm to give maximum torque. Movement along fine 25 caused by centrifugal mechanism.

Rotation of flange in direction 24 is caused by axial movement of outer shaft (connected to accelerator pedal) to produce required amount of late closing of intake valve to modulate torque output of engine.

At in-between situations the drive pin could be located anywhere in the aperture depending on accelerator position and engine rpm. It is interesting to note that while the centrifugal mechanism works to give the best or most inappropriate valve timing to maximise the torque output, the other function, the throttle free function, can be thought of as opposing it to give the most appropriate intake valve timing it can manage, at least it does in minimum power situations. The line (29) can be regarded as a fixed stop position which automatically adjusts to give the best valve timing at full power. This is because the load on the centrifugal weights is up so high, up to about 500 G at maximum rpm, and operating through a 3 to 1 mechanical advantage system to the drive plates any load from driving the camshaft or from the accelerator pedal would have little effect on the movement of the weights.

The main variation would be that both the mechanisms for the two functions could be located at the front or drive end of the camshaft plus the inner shaft locating thrust bearing, etc.

Since modifications within the spirit and scope of the invention may be readily effected by persons skilled in the art, it is to be understood that the invention is not limited to the particular embodiment described, by way of example, hereinabove.

What is claimed is:

1. A variable duration cam system, comprising:

a first shaft mounted so that it can move axially and having a cam;

the cam having a first end that has a first duration and a second end that has a second duration, and wherein the first duration is less than the second duration; the cam further comprising a cam face that is parallel to a centerline of the first shaft;

a slot disposed within the cam;

a rotatably mounted second shaft that is disposed axially within the first shaft;

a key mounted on the second shaft and having a distal end that extends through the slot to form a continuous surface with the cam face, wherein as the second shaft moves axially relative to the first shaft and the second shaft rotates, the key moves within the slot and mates with the cam face to vary the duration of the cam.

2. The variable duration cam system of claim 1, wherein the cam duration increases from the first cam end to the second cam end.

3. The variable duration cam system of claim 1, wherein the cam duration increases from about 250 degrees at the first cam end to about 360 degrees at the second cam end.

4. The variable duration cam system of claim 1, wherein the slot comprises a helical shape.

5. The variable duration cam system of claim 1, further comprising a means to rotate the second shaft.

6. The variable duration cam system of claim 5, wherein the means for rotating further comprises a means for increasing the speed of the second shaft which increases the cam duration.

7. The variable duration cam system of claim 1, further comprising a hydraulic actuator that rotates the second shaft.

8. The variable duration cam system of claim 1, further comprising a centrifugal mechanism that is coupled to the second shaft and that rotates the second shaft.

9. The variable duration cam system of claim 1, further comprising a hydraulic mechanism that rotates the second shaft.

10. The variable duration cam system of claim 1, wherein the cam comprises a sleeve that is slidably mounted on the first shaft.

11. The variable duration cam system of claim 1, wherein the first shaft further comprises a plurality of cams.

12. The method of claim 11, further comprising increasing the rotation of the second shaft relative to the cam and thereby increasing the cam duration.

13. The method of claim 11, wherein rotating the second shaft further comprises rotating the second shaft with a centrifugal mechanism.

14. The method of claim 11, wherein rotating the second shaft further comprises rotating the second shaft with a hydraulic mechanism.

15. The method of claim 11, wherein the cam duration is increased from about 250 degrees at the first cam end to about 360 degrees at the second cam end.

16. A method of varying the duration of a cam shaft, comprising:

(a) providing (a1) a first shaft mounted so that it can move axially and having a cam;

(a2) the cam having a first end that has a first duration and a second end that has a second duration, and wherein the first duration is less than the second duration; the cam further comprising a cam face that is parallel to a centerline of the first shaft;

(a3) a slot disposed within the cam;

(a4) a rotatably mounted second shaft that is disposed axially within the first shaft;

(a5) a key mounted on the second shaft and having a distal end that extends through the slot to form a continuous surface with the cam face, (b) rotating the second shaft relative to the cam to thereby move the key with the slot;

(c) moving the cam longitudinally relative to the second shaft to vary the cam duration relative to a follower.

* * * * *